US011311090B2

(12) United States Patent
deGrood et al.

(10) Patent No.: US 11,311,090 B2
(45) **Date of Patent: *Apr. 26, 2022**

(54) HAIR DRYER

(71) Applicant: Spectrum Brands, Inc., Middleton, WI (US)

(72) Inventors: Michael John deGrood, Madison, WI (US); Jay William Kuzia, Madison, WI (US)

(73) Assignee: SPECTRUM BRANDS, INC., Middleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/069,583

(22) Filed: Oct. 13, 2020

(65) Prior Publication Data

US 2021/0022472 A1 Jan. 28, 2021

Related U.S. Application Data

(63) Continuation of application No. 15/650,590, filed on Jul. 14, 2017, now Pat. No. 10,835,007.

(51) Int. Cl.
*A45D 20/12* (2006.01)

(52) U.S. Cl.
CPC ..... *A45D 20/12* (2013.01); *A45D 20/122* (2013.01)

(58) Field of Classification Search
CPC .. A45D 20/00; A45D 20/10; A45D 2020/128; F24H 3/0417; F24H 3/0423
See application file for complete search history.

(56) References Cited

U.S. PATENT DOCUMENTS 2,432,067 A * 12/1947 Morse ..... A45D 20/10 392/385
2,834,866 A 5/1958 Bentzman
3,095,496 A 6/1963 Omohundro
3,284,611 A 11/1966 Laing
3,348,020 A 10/1967 Cooper
3,397,463 A 8/1968 Laing
(Continued)

FOREIGN PATENT DOCUMENTS

EP 980499 A1 2/2000
EP 1034719 A1 9/2000
(Continued)

OTHER PUBLICATIONS

International Preliminary Report on Patentability issued in PCT Application No. PCT/US2018/041835, dated Aug. 16, 2019.

*Primary Examiner* — Gregory A Wilson
(74) *Attorney, Agent, or Firm* — Armstrong Teasdale LLP

(57) ABSTRACT

A handheld hair dryer includes a body extending about an axis and including a first end, a second end, an inner wall, and an outer wall. The outer wall and the inner wall extend from the first end of the body to the second end of the body and define a cavity therebetween. A central passage is defined by the inner wall. The hair dryer also includes an inlet defined by the inner wall and an outlet for the airflow to exit the cavity. The inlet is defined by the inner wall intermediate the first end and the second end. The hair dryer is configured to direct the airflow through the cavity and towards the outlet. The hair dryer further includes a handle connected to the body, a fan, and a motor positioned at least partly within the handle and coupled to the fan.

20 Claims, 14 Drawing Sheets

(56) References Cited

U.S. PATENT DOCUMENTS

| | | | | |
|---|---|---|---|---|
| 3,674,980 | A | 7/1972 | Cox | |
| 3,854,489 | A | 12/1974 | Doyle et al. | |
| 3,894,547 | A | 7/1975 | Scivoletto | |
| 4,066,865 | A | 1/1978 | Godel et al. | |
| 4,308,670 | A * | 1/1982 | Bonnema | A45D 20/50 132/219 |
| 4,309,595 | A | 1/1982 | Long et al. | |
| 4,320,283 | A | 3/1982 | Voigt | |
| 4,538,362 | A | 9/1985 | Andis | |
| 4,596,921 | A | 6/1986 | Hersh | |
| 4,735,002 | A * | 4/1988 | Rath | A45D 20/08 34/97 |
| 4,903,416 | A | 2/1990 | Levin | |
| 4,936,027 | A | 6/1990 | Tsuji | |
| 5,467,540 | A | 11/1995 | Bastien | |
| 5,479,951 | A | 1/1996 | Denebeim | |
| 5,546,674 | A | 8/1996 | Lange et al. | |
| 5,555,637 | A * | 9/1996 | Montagnino | A45D 20/10 34/97 |
| 5,621,980 | A | 4/1997 | Kingsbury | |
| 5,649,370 | A | 7/1997 | Russo | |
| 5,738,121 | A | 4/1998 | Westerveld et al. | |
| 5,765,292 | A | 6/1998 | Chan | |
| 5,841,943 | A * | 11/1998 | Nosenchuck | A45D 20/10 392/385 |
| 5,868,148 | A | 2/1999 | Lindsey et al. | |
| 5,875,562 | A * | 3/1999 | Fogarty | A45D 20/10 34/97 |
| 5,954,064 | A | 9/1999 | Motherhead | |
| 5,956,863 | A | 9/1999 | Allen | |
| 5,966,833 | A | 10/1999 | Andis et al. | |
| 6,011,903 | A | 1/2000 | Nosenchuck | |
| 6,085,435 | A | 7/2000 | Russi | |
| 6,227,846 | B1 | 5/2001 | Zagoroff | |
| 6,437,704 | B1 | 8/2002 | Nodinger | |
| 6,502,585 | B1 | 1/2003 | Mazzei et al. | |
| 6,532,968 | B1 | 3/2003 | Hafemann | |
| 6,591,516 | B2 | 7/2003 | Kamada et al. | |
| 6,715,215 | B1 * | 4/2004 | Yeung | A45D 20/12 34/96 |
| 6,922,909 | B2 | 8/2005 | Andrew et al. | |
| 7,428,785 | B2 | 9/2008 | Kim | |
| D598,532 | S | 8/2009 | Dyson et al. | |
| D602,143 | S | 10/2009 | Gammack et al. | |
| D602,144 | S | 10/2009 | Dyson et al. | |
| D605,748 | S | 12/2009 | Gammack et al. | |
| D614,280 | S | 4/2010 | Dyson et al. | |
| D643,098 | S | 8/2011 | Wallace et al. | |
| 8,091,564 | B2 | 1/2012 | Hafemann | |
| 8,272,142 | B2 | 9/2012 | Hall | |
| D672,023 | S | 12/2012 | Wallace et al. | |
| D672,024 | S | 12/2012 | Fitton et al. | |
| D715,995 | S | 10/2014 | Dyson et al. | |
| D715,996 | S | 10/2014 | Dyson et al. | |
| D716,492 | S | 10/2014 | Dyson et al. | |
| D728,092 | S | 4/2015 | Poulton et al. | |
| D728,769 | S | 5/2015 | Dyson et al. | |
| D728,770 | S | 5/2015 | Dyson et al. | |
| D729,372 | S | 5/2015 | McPherson et al. | |
| D729,373 | S | 5/2015 | Dos Reis et al. | |
| D729,374 | S | 5/2015 | Dos Reis et al. | |
| D729,375 | S | 5/2015 | Dos Reis et al. | |
| D729,376 | S | 5/2015 | McPherson et al. | |
| D729,447 | S | 5/2015 | Gammack | |
| D729,448 | S | 5/2015 | Gammack | |
| D729,925 | S | 5/2015 | McPherson et al. | |
| D729,978 | S | 5/2015 | Bates et al. | |
| D729,979 | S | 5/2015 | Gammack | |
| D730,575 | S | 5/2015 | Bates et al. | |
| D730,576 | S | 5/2015 | Gammack | |
| D731,117 | S | 6/2015 | Bates et al. | |
| 9,144,286 | B2 | 9/2015 | Courtney et al. | |
| D741,544 | S | 10/2015 | Gammack | |
| 9,173,468 | B2 | 11/2015 | Moloney et al. | |
| D746,425 | S | 12/2015 | Dyson et al. | |
| D746,966 | S | 1/2016 | Dyson et al. | |
| D747,450 | S | 1/2016 | Dyson et al. | |
| D749,231 | S | 2/2016 | Dyson et al. | |
| 9,282,799 | B2 | 3/2016 | Courtney et al. | |
| 9,282,800 | B2 | 3/2016 | Courtney et al. | |
| D757,361 | S | 5/2016 | Gammack | |
| D757,362 | S | 5/2016 | Dyson et al. | |
| D758,010 | S | 5/2016 | Bates et al. | |
| D758,011 | S | 5/2016 | Gammack | |
| D758,012 | S | 5/2016 | Bates et al. | |
| 9,326,591 | B2 | 5/2016 | Nicoline | |
| 9,414,662 | B2 | 8/2016 | Moloney et al. | |
| 9,420,864 | B2 | 8/2016 | Gammack et al. | |
| 9,420,865 | B2 | 8/2016 | Gammack et al. | |
| 9,526,310 | B2 | 12/2016 | Courtney | |
| 9,681,726 | B2 * | 6/2017 | Moloney | A45D 20/10 |
| 10,004,313 | B2 * | 6/2018 | Atkinson | A45D 20/00 |
| 10,441,049 | B2 * | 10/2019 | Douglas | A45D 20/12 |
| 2002/0078587 | A1 | 6/2002 | White | |
| 2005/0069303 | A1 | 3/2005 | Maione et al. | |
| 2006/0254073 | A1 * | 11/2006 | Zhen | A45D 20/10 34/96 |
| 2009/0064529 | A1 | 3/2009 | Kang | |
| 2009/0083986 | A1 | 4/2009 | Langley et al. | |
| 2009/0100698 | A1 | 4/2009 | Primm | |
| 2012/0266483 | A1 * | 10/2012 | Palermo | A45D 20/10 34/97 |
| 2013/0111777 | A1 | 5/2013 | Jeong | |
| 2013/0232809 | A1 | 9/2013 | Vasquez | |
| 2013/0269200 | A1 | 10/2013 | Moloney et al. | |
| 2013/0276320 | A1 | 10/2013 | Courtney et al. | |
| 2013/0283630 | A1 | 10/2013 | Courtney et al. | |
| 2014/0007448 | A1 | 1/2014 | Courtney et al. | |
| 2015/0007442 | A1 | 1/2015 | Gammack et al. | |
| 2015/0007443 | A1 | 1/2015 | Gammack et al. | |
| 2015/0007444 | A1 | 1/2015 | Moloney et al. | |
| 2015/0007854 | A1 | 1/2015 | Moloney et al. | |
| 2015/0007855 | A1 | 1/2015 | Moloney et al. | |
| 2015/0026993 | A1 | 1/2015 | Sutter et al. | |
| 2015/0082652 | A1 | 3/2015 | Atkinson | |
| 2015/0089828 | A1 | 4/2015 | Moloney et al. | |
| 2015/0093099 | A1 | 4/2015 | Shelton et al. | |
| 2015/0157106 | A1 | 6/2015 | Atkinson | |
| 2015/0157107 | A1 | 6/2015 | Gosnay et al. | |
| 2015/0189967 | A1 | 7/2015 | McNeeley et al. | |
| 2016/0000201 | A1 | 1/2016 | Doran | |
| 2016/0022004 | A1 | 1/2016 | Johnson | |
| 2016/0120286 | A1 | 5/2016 | Han | |
| 2016/0143409 | A1 | 5/2016 | Moloney et al. | |
| 2016/0166033 | A1 | 6/2016 | Kerr et al. | |
| 2016/0166035 | A1 | 6/2016 | Douglas et al. | |
| 2016/0206075 | A1 | 7/2016 | Stephens et al. | |
| 2016/0206076 | A1 * | 7/2016 | Stephens | A45D 20/10 |
| 2016/0206077 | A1 | 7/2016 | Stephens et al. | |
| 2016/0220004 | A1 | 8/2016 | Moloney et al. | |
| 2016/0230777 | A1 | 8/2016 | Dao | |
| 2016/0235178 | A1 | 8/2016 | Atkinson et al. | |

FOREIGN PATENT DOCUMENTS

| | | | |
|---|---|---|---|
| EP | 1123019 | B1 | 4/2003 |
| EP | 940101 | B1 | 9/2003 |
| EP | 1222871 | B1 | 9/2004 |
| EP | 1973442 | A2 | 10/2008 |
| EP | 2198740 | B1 | 11/2011 |
| EP | 2462831 | A2 | 6/2012 |
| EP | 2736374 | A1 | 6/2014 |
| EP | 2740383 | A2 | 6/2014 |
| EP | 2830458 | A1 | 2/2015 |
| EP | 2830459 | A1 | 2/2015 |
| EP | 2830460 | A1 | 2/2015 |
| EP | 2830461 | A1 | 2/2015 |
| EP | 2830462 | A1 | 2/2015 |
| EP | 2830463 | A1 | 2/2015 |
| EP | 2869726 | A1 | 5/2015 |
| EP | 3016539 | A1 | 5/2016 |
| EP | 3016540 | A1 | 5/2016 |
| EP | 3016541 | A1 | 5/2016 |

(56) References Cited

FOREIGN PATENT DOCUMENTS

| | | | |
|---|---|---|---|
| EP | 3016542 | A1 | 5/2016 |
| EP | 3016544 | A1 | 5/2016 |
| EP | 3016545 | A1 | 5/2016 |
| EP | 3024352 | A1 | 6/2016 |
| EP | 2823726 | B1 | 8/2016 |
| GB | 2316610 | A | 3/1998 |
| JP | 2016174974 | A | 10/2016 |
| KR | 20160096330 | A | 8/2016 |
| WO | 1994023611 | A1 | 10/1994 |
| WO | 2001015568 | A1 | 3/2001 |
| WO | 2001052689 | A1 | 7/2001 |
| WO | 2013014093 | A1 | 1/2013 |
| WO | 2013144573 | A1 | 10/2013 |
| WO | 2015001309 | A1 | 1/2015 |
| WO | 2015044646 | A1 | 4/2015 |
| WO | 2015087040 | A1 | 6/2015 |
| WO | 2015150720 | A1 | 10/2015 |
| WO | 2016108018 | A1 | 7/2016 |
| WO | 2016116728 | A1 | 7/2016 |
| WO | 2016116729 | A1 | 7/2016 |
| WO | 2016116730 | A1 | 7/2016 |

* cited by examiner

HAIR DRYER

CROSS-REFERENCE TO RELATED APPLICATION

This application is a continuation of U.S. patent application Ser. No. 15/650,590 filed on Jul. 14, 2017, which is incorporated herein by reference in its entirety.

FIELD OF THE DISCLOSURE

The present disclosure relates generally to a hair dryer, and more particularly to a handheld hair dryer including an annular body.

BACKGROUND OF THE DISCLOSURE

Hair dryers are configured to generate an airflow that is directed towards hair to dry the hair. At least some known hair dryers include a handle that allows a user to hold the hair dryer and position the hair dryer relative to the hair. Most hair dryers include an airflow duct that extends between an inlet and an outlet. Components such as heaters, fans, and motors are positioned along the airflow duct and are used to process the airflow. However, the configuration of the airflow duct and the processing components may increase the size of the hair dryer. In addition, the hair dryers may be difficult for a user to hold and position. Moreover, the configuration of the airflow duct may limit the operating efficiency of the hair dryer.

Accordingly, it is desirable to provide a hair dryer that has a reduced size and an increased operating efficiency.

SUMMARY

In one aspect, a handheld hair dryer includes a body extending about an axis. The body includes a first end, a second end, an inner wall, and an outer wall. The outer wall is spaced radially outward from the inner wall. The inner wall and the outer wall define a cavity therebetween. A central passage is defined by the inner wall. The outer wall and the inner wall extend from the first end of the body to the second end of the body. The hair dryer also includes an inlet defined by the inner wall and an outlet for the airflow to exit the cavity. The inlet is in flow communication with the central passage to allow airflow in the central passage to be drawn into the cavity through the inlet. The inlet is defined by the inner wall intermediate the first end and the second end. The hair dryer is configured to direct the airflow through the cavity and towards the outlet. The hair dryer further includes a handle connected to the body, a fan, and a motor positioned at least partly within the handle and coupled to the fan.

In another aspect, an air-moving appliance includes a cylindrical body extending about an axis. The body includes a first end and a second end. The body defines a cavity and a central passage extending from the first end to the second end. The air-moving appliance also includes an inlet defined by the body and an outlet for the airflow to exit the cavity. The inlet is in flow communication with the central passage to allow airflow in the central passage to be drawn into the cavity through the inlet. The inlet is defined by the body intermediate the first end and the second end. The hair dryer is configured to direct the airflow through the cavity and towards the outlet. The air-moving appliance further includes a handle connected to the body, a fan positioned above the handle, and a motor positioned at least partly within the handle and coupled to the fan.

BRIEF DESCRIPTION OF THE DRAWINGS

Corresponding reference characters indicate corresponding parts throughout the drawings.

DETAILED DESCRIPTION OF THE DRAWINGS

Figure 1:
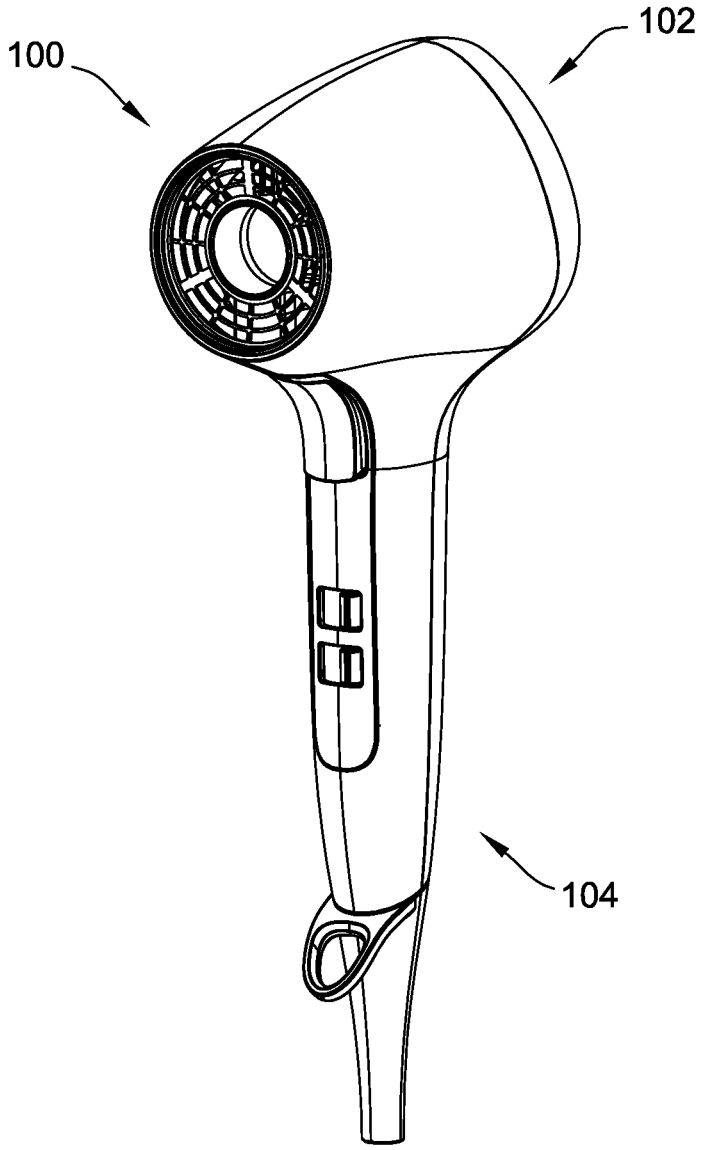
FIG. 1 is a perspective view of a first embodiment of a hair dryer including an annular body.
Figure 2:
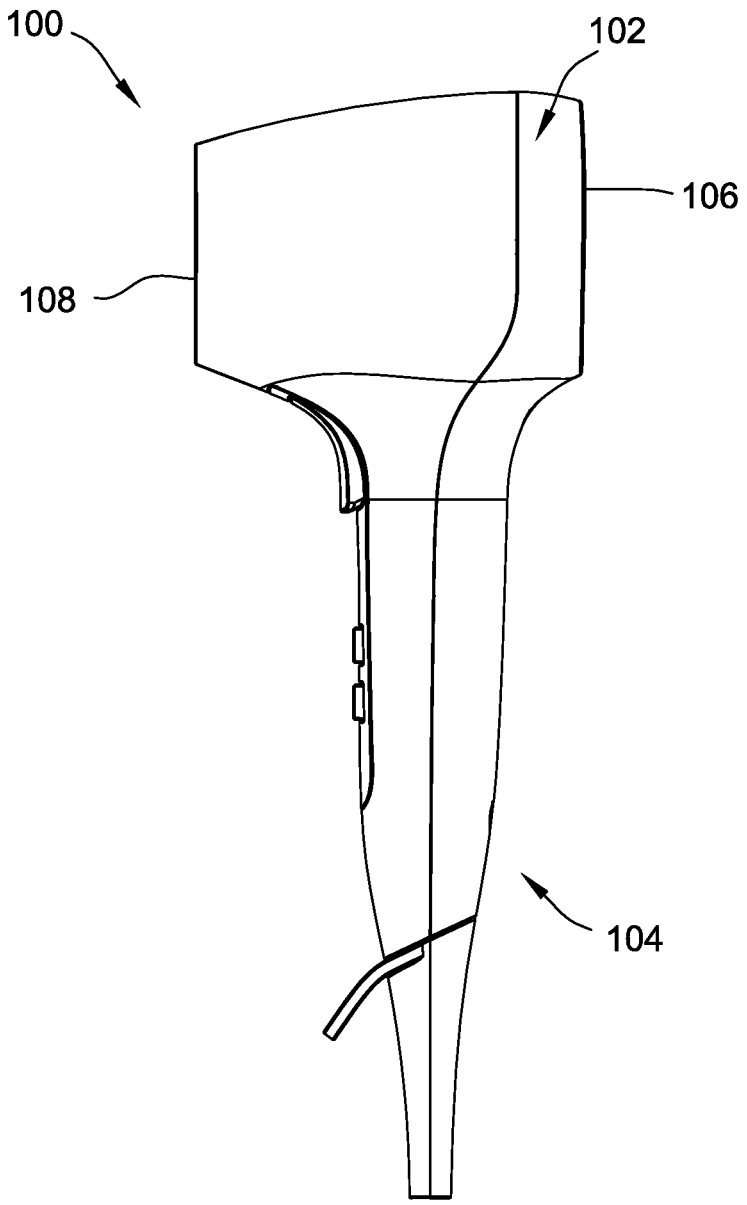
FIG. 2 is a right elevational view of the hair dryer of FIG. 1.
Figure 3:
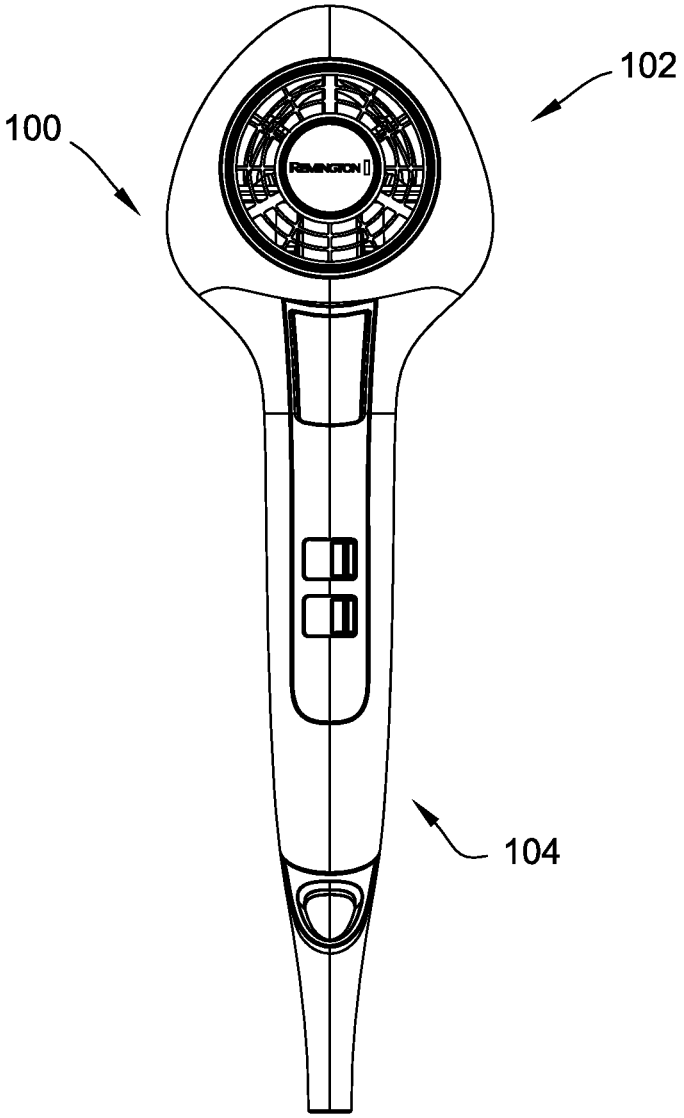
FIG. 3 is a front elevational view of the hair dryer of FIG. 1.
Figure 4:
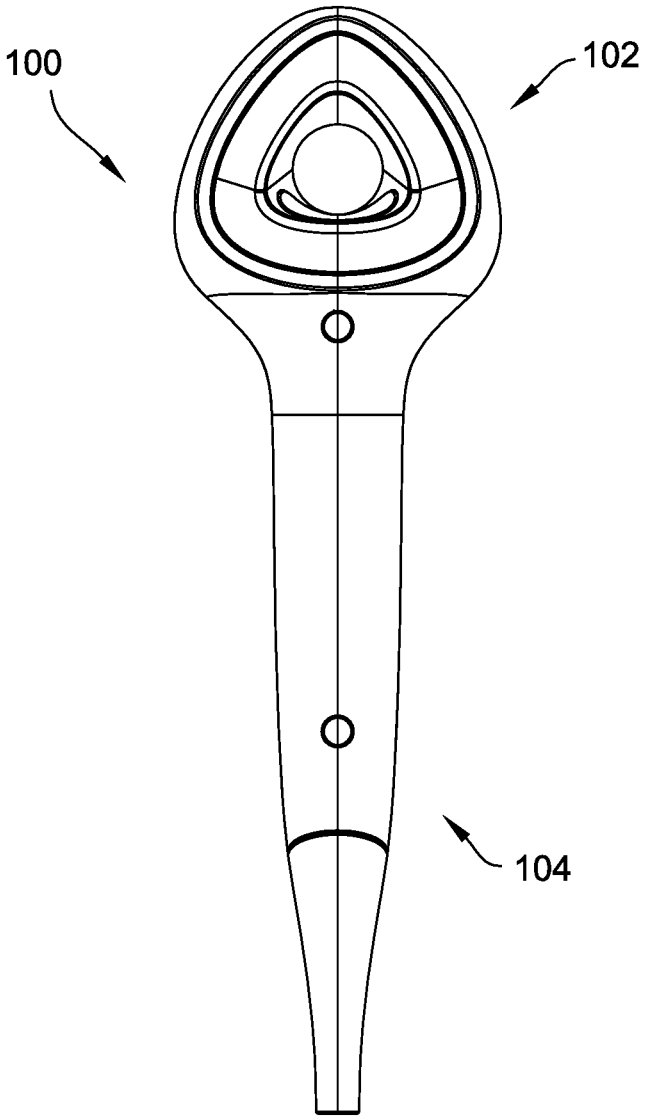
FIG. 4 is a rear elevational view of the hair dryer of FIG. 1.

Referring to the drawings, and in particular to FIGS. 1-7, one embodiment of a hair dryer, broadly an air-moving appliance, is generally indicated at 100. The hair dryer 100 includes a body 102 and a handle 104. In general, the hair dryer 100 is adapted to direct heated air to hair to remove moisture from the hair. In some embodiments, the hair dryer 100 may include a user interface to enable a user to control the hair dryer 100. Suitable user interfaces include, for example and without limitation, screens, buttons, knobs, levers, and/or switches. The hair dryer 100 may have other suitable configurations without departing from the scope of this invention.

As shown in FIGS. 1-4, the handle 104 extends downward from the body 102 and is configured to be held by a user during operation of the hair dryer 100. Accordingly, the hair dryer 100 is handheld. In the illustrated embodiment, the body 102 and the handle 104 are connected together to form a single housing assembly. In other embodiments, the hair dryer 100 may include other handles without departing from the scope of this invention.

Figure 5:
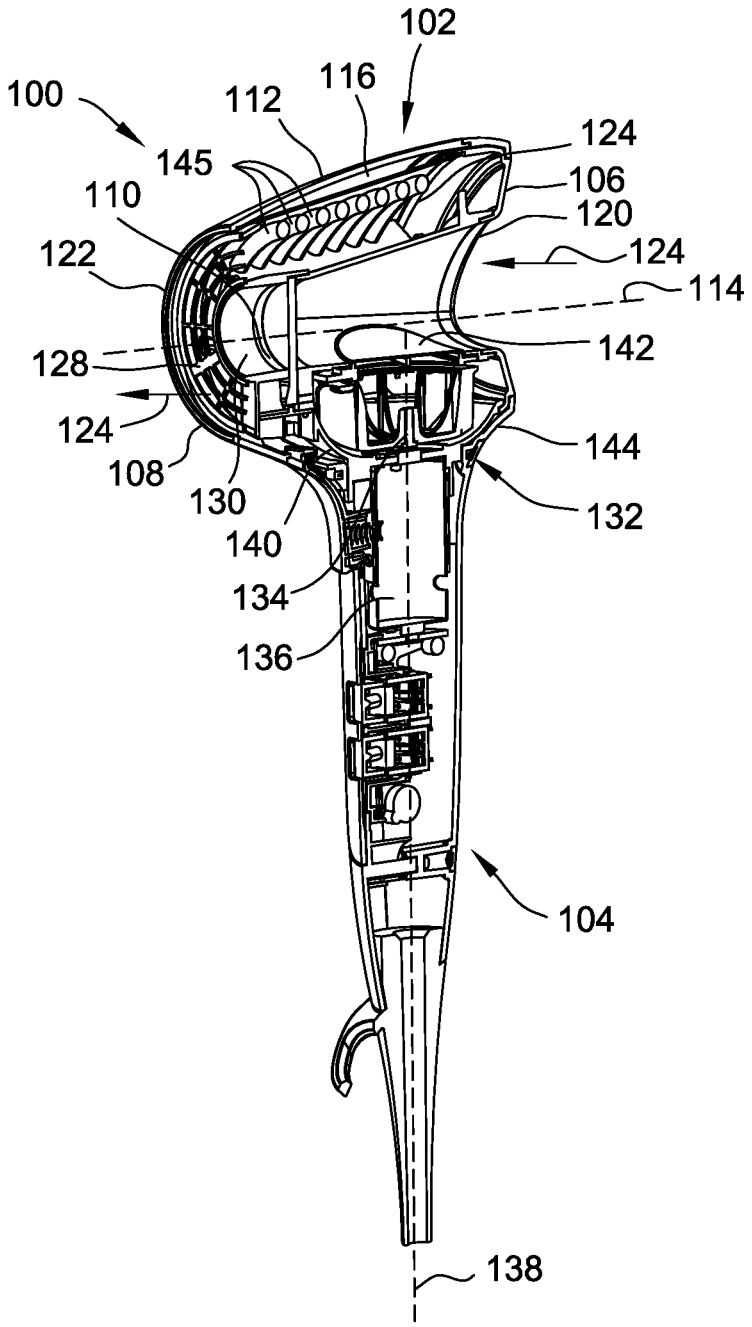
FIG. 5 is a schematic sectional view of the hair dryer of FIG. 1 showing airflow through the hair dryer.
Figure 6:
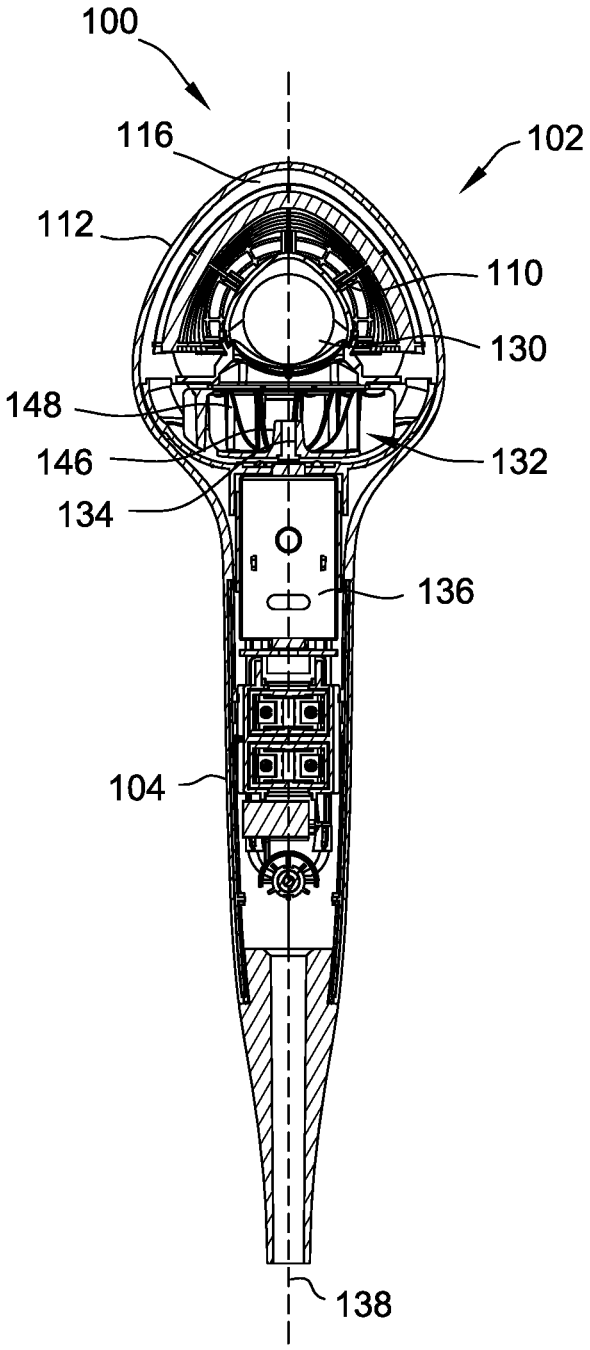
FIG. 6 is a rear sectional view of the hair dryer of FIG. 1.

In reference to FIG. 5, in the illustrated embodiment, the body 102 includes a first (or rear) end 106, a second (or front) end 108, an inner wall 110, and an outer wall 112. The inner wall 110 and the outer wall 112 extend from the first end 106 to the second end 108 about a central axis 114. In addition, the outer wall 112 is spaced radially outward from the inner wall 110 such that the outer wall 112 and the inner wall 110 cooperatively define a cavity 116 therebetween. In the illustrated embodiment, the outer wall 112 and the inner wall 110 are generally cylindrical and the outer wall 112 circumscribes the inner wall 110. Accordingly, the body 102 and the cavity 116 have an annular shape. In addition, in the illustrated embodiment, the outer wall 112 has a decreasing diameter between the first end 106 and the second end 108 such that the body 102 tapers between the first end 106 and the second end 108. In alternative embodiments, the hair dryer 100 may include any body 102 that enables the hair dryer 100 to operate as described herein.

The inner wall 110 defines an inlet 120 for airflow 124 to enter the cavity 116 at a location intermediate the first end 106 and the second end 108. In addition, the inner wall 110 and the outer wall 112 define an outlet 122 for the airflow 124 to exit the cavity 116. The outlet 122 is located at the second end 108. During operation, the hair dryer 100 draws the airflow 124 into the inlet 120, directs the airflow 124 through the cavity 116, and discharges the airflow 124 through the outlet 122. The hair dryer 100 includes a grill 128 extending across the outlet 122 to prevent objects passing through the outlet 122. In the illustrated embodiment, the inlet 120 is circular and the outlet 122 is annular. The hair dryer 100 may include other inlets and/or outlets without departing from some aspects of the invention.

In the illustrated embodiment, the inner wall 110 defines a central passage 130 extending from the first end 106 to the second end 108 along the central axis 114. Airflow 124 travels through the central passage 130 along the central axis 114. The inlet 120 is located intermediate the first end 106 and the second end 108 and is in flow communication with the central passage 130. Accordingly, the inlet 120 allows the airflow 124 through the central passage 130 to be drawn into the cavity 116. In other embodiments, the hair dryer 100 may include other central passages 130 without departing from some aspects of the invention. For example, in some embodiments, the central passage 130 may extend from the first end 106 to the inlet 120 and may not necessarily extend continuously to the second end 108.

The inner wall 110 and the outer wall 112 are connected at the first end 106 such that the cavity 116 is sealed at the first end 106. The inner wall 110 and the outer wall 112 may be connected in any suitable manner. For example, in some embodiments, the inner wall 110 and the outer wall 112 are integrally formed. In further embodiments, the inner wall 110 and the outer wall 112 are formed separately and are fastened together.

The hair dryer 100 may receive power from any suitable power source. For example, in some embodiments, the hair dryer 100 may include a power cord that connects to an external power source. In further embodiments, the hair dryer may be at least partially powered by an internal power source such as a battery.

In reference to FIGS. 6-9, a fan 132 is positioned in the body 102 adjacent the inlet 120. The fan 132 is connected to a drive shaft 134 operatively connected to a motor 136. The motor 136, in the illustrated embodiment, is located in the handle 104. The fan 132 is located in the body 102 above the handle 104 such that the fan 132 and the motor 136 have a stacked configuration. Moreover, the motor 136 and the fan 132 are oriented in a direction substantially perpendicular to the central axis 114. As a result, the motor 136 and the fan 132 allow the hair dryer 100 to have a reduced size. In particular, the size of the body 102 may be reduced because the motor 136 is positioned in the handle 104 and the fan 132 is offset from components such as heating units in the body 102. In addition, the hair dryer 100 may be easier for a user to position because the motor 136 and the fan 132 are aligned with the handle 104. In other embodiments, the motor 136 and/or the fan 132 may be at least partially located in the handle 104 and/or the body 102.

During operation, the motor 136 is configured to rotate the fan 132 about a rotation axis 138. The rotation axis 138 is perpendicular to the central axis 114. When the motor 136 rotates the fan 132, the fan 132 is configured to draw the airflow 124 into the inlet 120 and direct the airflow 124 through the cavity 116. The inner wall 110 and the outer wall 112 direct the airflow 124 through the cavity 116 and towards the outlet 122. In addition, the body 102 is configured to distribute the airflow 124 evenly throughout the cavity 116 prior to discharge through the outlet 122. As shown in FIG. 5, the airflow 124 is directed around the inner wall 110 and throughout the annular cavity 116.

As shown in FIG. 5, the inner wall 110 defines an inlet 120. In the illustrated embodiment, the inlet 120 has a diameter or width that is substantially equal to the width of the central passage 130 and facilitates the airflow 124 from the central passage 130 being drawn into the cavity 116. An interface 142 extends across the inlet 120. The interface 142 includes a plurality of openings and is configured to direct the airflow 124 into the cavity 116. In particular, the interface 142 directs the airflow 124 towards the center of the fan 132 in a direction parallel to the rotation axis 138. In this embodiment, the interface 142 is formed separately from the inner wall 110 and is coupled to the inner wall 110. In other embodiments, the interface 142 may be integrally formed with the inner wall 110. In some embodiments, the interface 142 may include a mesh or screen to prevent objects entrained in the airflow 124 from entering the cavity 116 and possibly damaging the fan 132.

A bottom portion 144 of the outer wall 112 adjacent the handle 104 is substantially concave and provides a transition from the cylindrical shape of the handle 104 to the annular shape of the body 102. In addition, the interior of the bottom portion 144 directs the airflow 124 generally upward such that the airflow 124 is uniformly distributed throughout the cavity 116 prior to discharge through the outlet 122.

One or more heating units 145 may be positioned within the cavity 116. The heating units 145 may be configured to increase the temperature of the airflow 124 prior to the airflow 124 being discharged through the outlet 122. In suitable embodiments, the heating units 145 may have a power rating of about 1,000 watts to about 2,600 watts.

In addition, the fan 132 and the motor 136 are configured to discharge the airflow 124 at a desired rate. For example, the hair dryer 100 may be configured to discharge the airflow 124 at a rate in a range of about 30 cubic feet per minute to about 75 cubic feet per minute.

The hair dryer 100 may have any operating setting that enables the hair dryer to operate as described herein. For example, the motor 136 may have two or more operating speeds. In addition, the hair dryer 100 may include different temperature settings. For example, in some embodiments, the hair dryer 100 may include a heating unit including two or more different temperatures settings. Moreover, the hair dryer 100 may be configured to deliver airflow 124 having a temperature at or below the temperature of the ambient environment, i.e., a cool stream.

Also, the hair dryer 100 may include attachments such as a concentrator, a diffuser, a pick, a nozzle, a straightener, and any other suitable attachments. The attachments may be configured to attach to the second end 108 of the body 102 adjacent the outlet 122. Accordingly, at least a portion of the attachments may be annular in shape. The attachments may be connected to the body 102 in any manner that enables the hair dryer 100 to operate as described herein.

Figure 10:
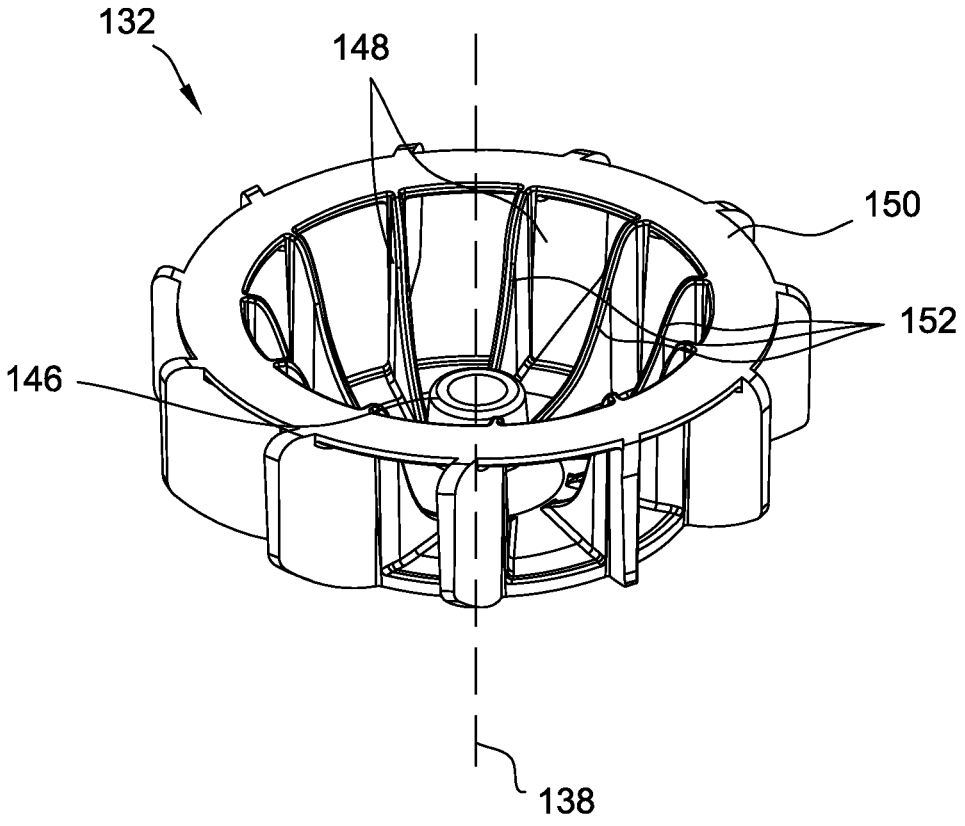
FIG. 10 is a perspective view of the fan of FIG. 9.
Figure 11:
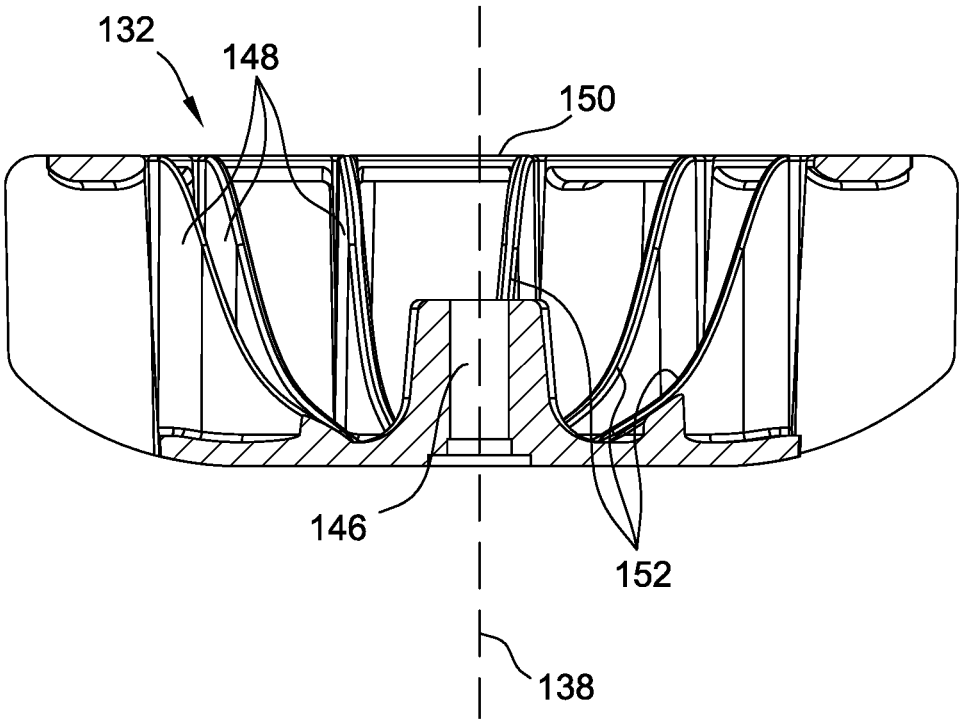
FIG. 11 is a sectional view of the fan of FIGS. 9 and 10.

FIG. 10 is a perspective view of the fan 132. FIG. 11 is a sectional view of the fan 132. The fan 132 includes a hub 146 and a plurality of blades 148. The blades 148 extend upward from the hub 146 and radially outward from the rotation axis 138. Accordingly, the fan 132 is configured to turn or redirect the airflow 124 (shown in FIG. 5) in a direction that is different from the direction of the airflow 124 entering the fan 132. Specifically, in the illustrated embodiment, the fan 132 is a radial fan and the airflow 124 is directed in a radial direction relative to the rotation axis 138. The fan 132 may have other suitable configurations without departing from some aspects of the invention.

The blades 148 extend radially from the rotation axis 138 and are spaced equal angular distances apart. Each blade 148 includes curved edges 152 and is shaped to direct the airflow 124 radially outward. A ring 150 is connected to the blades 148 and provides support to the blades 148. In other embodiments, the fan 132 may include other blades without departing from some aspects of the invention.

Figure 7:
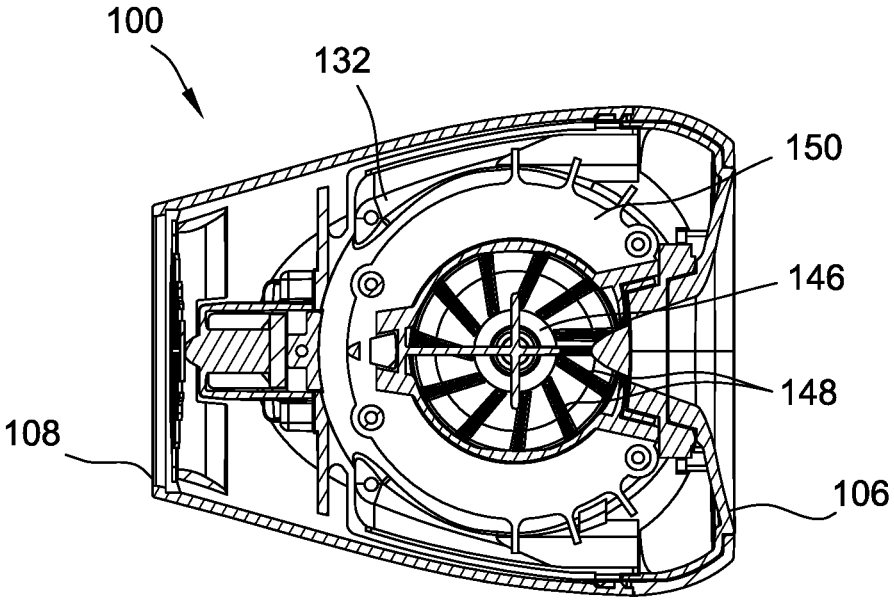
FIG. 7 is a top sectional view of the hair dryer of FIG. 1.
Figure 8:
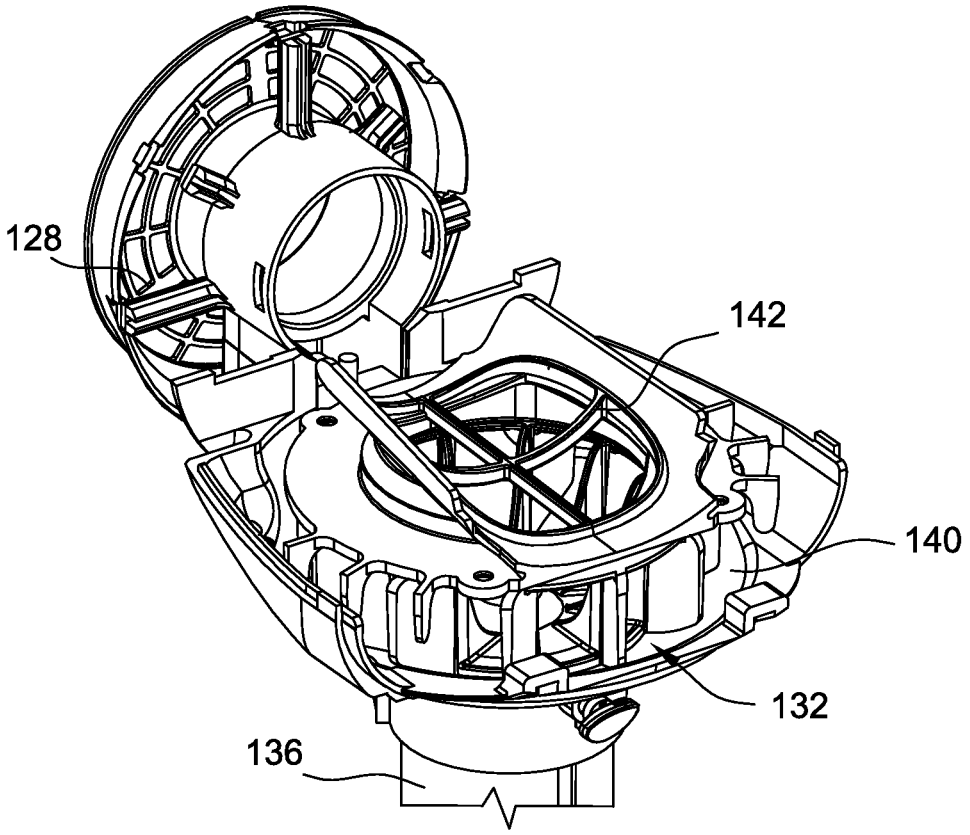
FIG. 8 is an enlarged perspective view of a portion of the hair dryer of FIG. 1.
Figure 9:
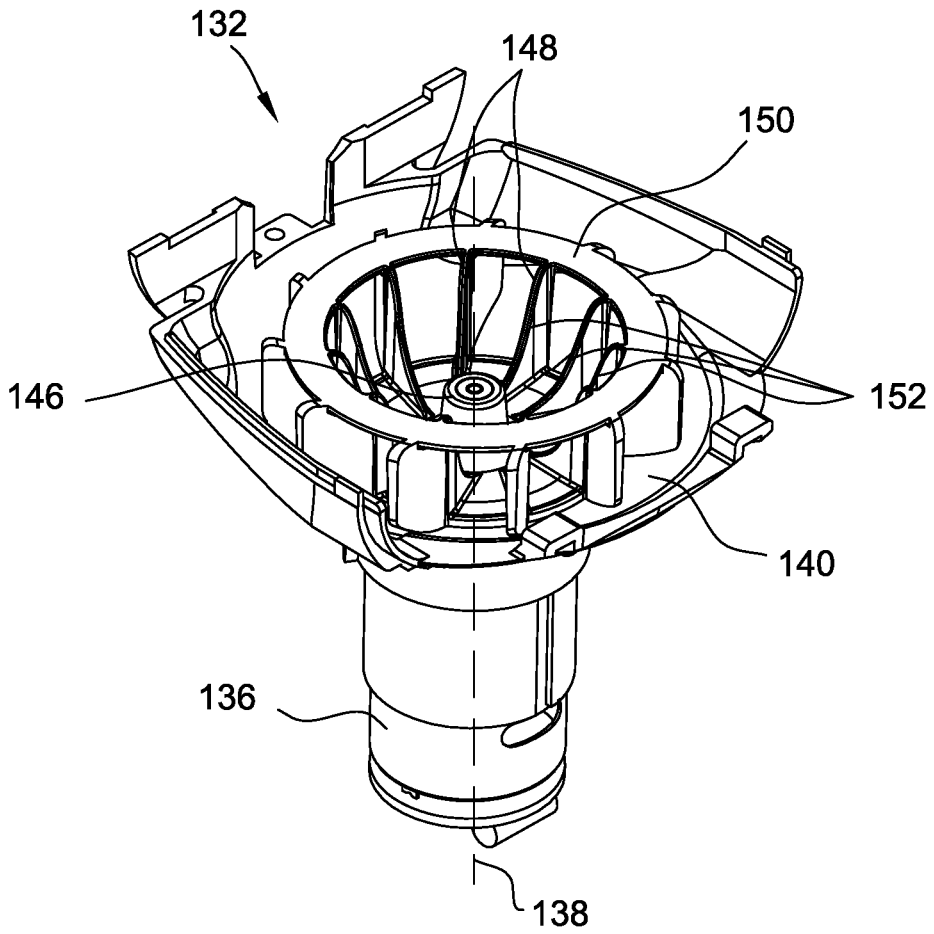
FIG. 9 is an enlarged perspective view of a fan and a motor of the hair dryer of FIG. 1.

In reference to FIGS. 5 and 7, a center of the hub 146 of the fan 132 is connected to the drive shaft 134 such that the rotation axis 138 of the fan 132 is substantially perpendicular to the central axis 114. During operation, the fan 132 is configured to rotate about the rotation axis 138 to draw the airflow 124 into the cavity 116 through the inlet 120. The airflow 124 is drawn towards the center of the fan 132 in a direction substantially parallel to the rotation axis 138. The blades 148 direct the airflow 124 radially outward. A shroud or bowl 140 extending around the fan 132 redirects the airflow 124 in a direction opposite the direction of the airflow 124 entering the fan 132 such that the airflow 124 is discharged into the cavity 116 in a direction parallel to the rotation axis 138 and spaced radially from the rotation axis 138. Accordingly, the airflow 124 is directed into the cavity 116 around the exterior of the inlet 120. The fan 132 and the bowl 140 facilitate the airflow 124 flowing around the inlet 120 and being distributed throughout the cavity 116.

Figure 12:
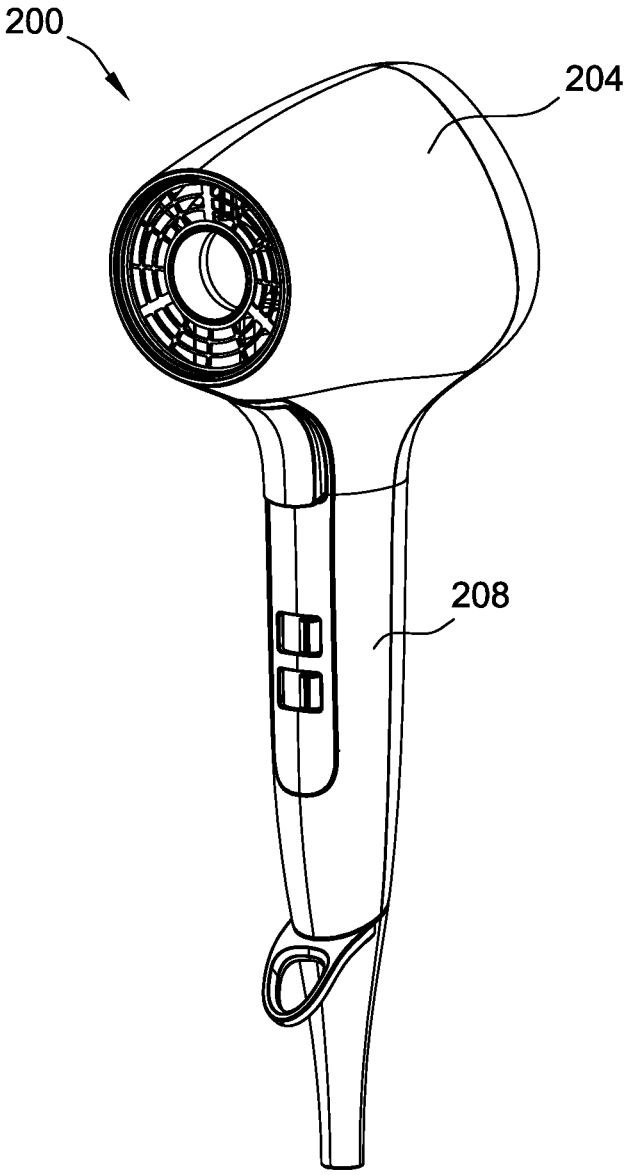
FIG. 12 perspective view of a second embodiment of a hair dryer including an annular body and a central shield.
Figure 13:
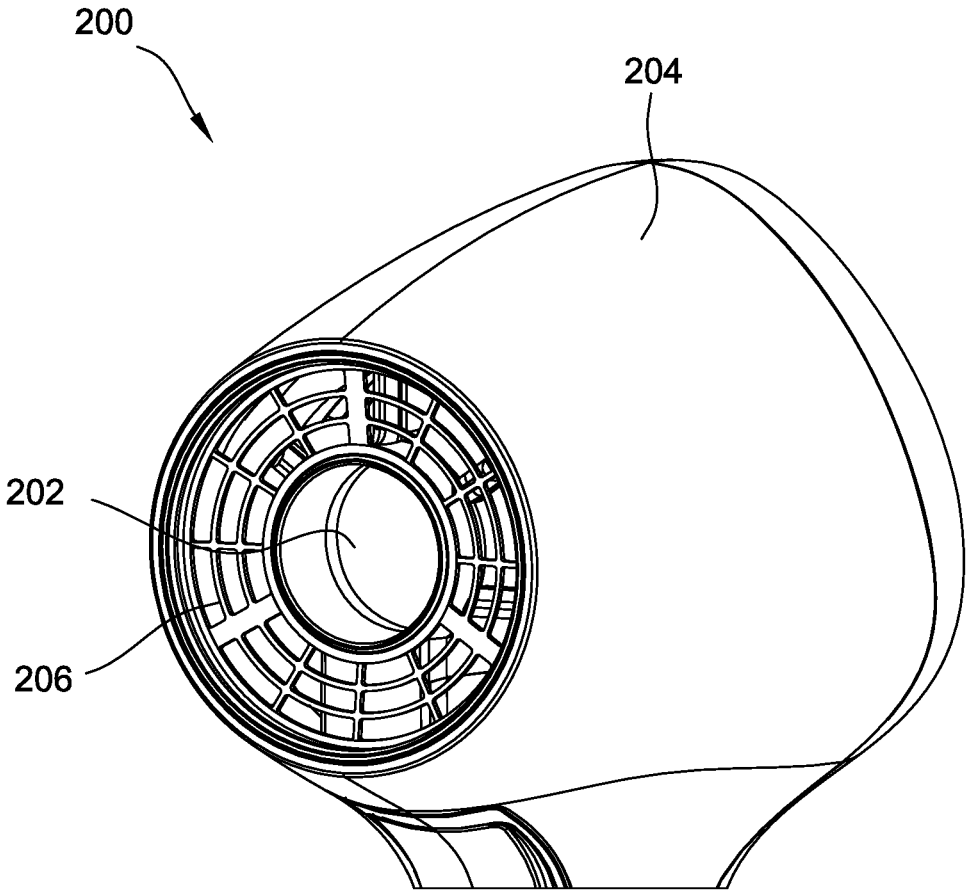
FIG. 13 is an enlarged perspective view of a portion of the hair dryer of FIG. 12.
Figure 14:
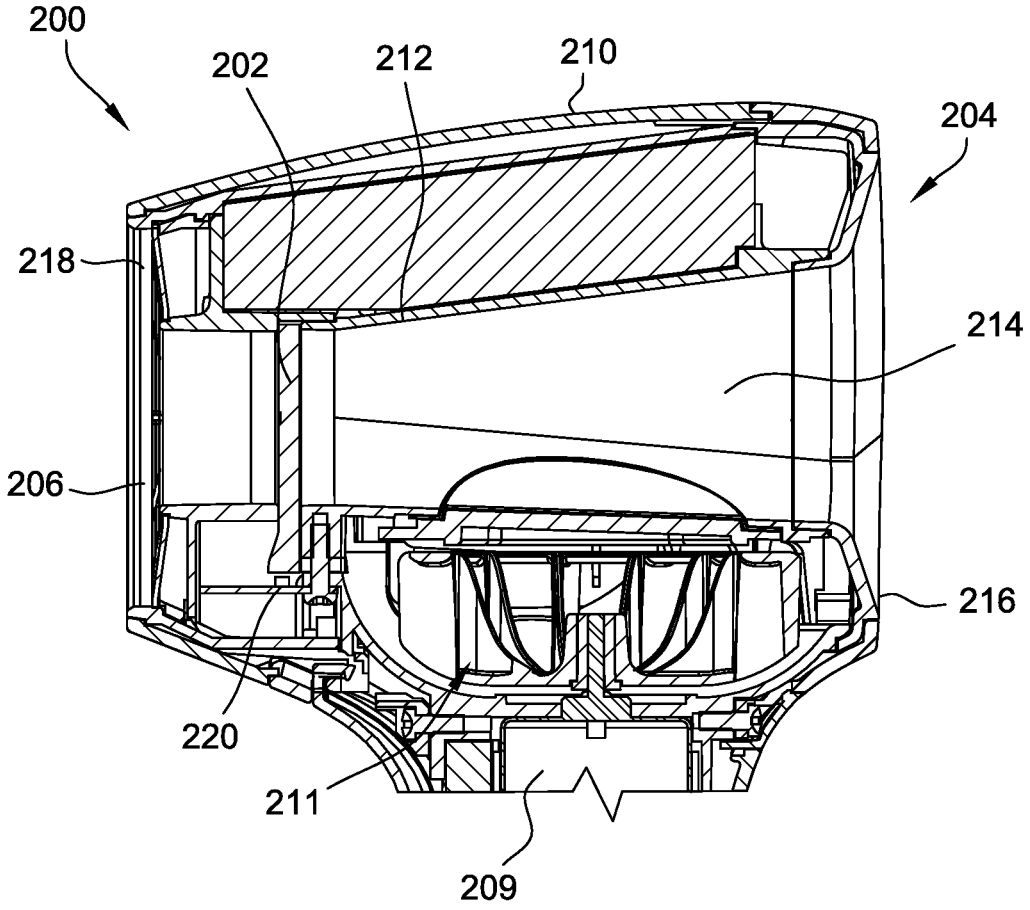
FIG. 14 is a schematic sectional view of the hair dryer of FIGS. 12 and 13.

Referring now to FIGS. 12-14, a second embodiment of a hair dryer is generally indicated at 200. The hair dryer 200 is substantially similar to the hair dryer 100 except the hair dryer 200 includes a shield 202. The hair dryer 200 includes shield 202, a body 204, a grill 206, a handle 208, a motor 209, and a fan 211. The body 204 includes an outer wall 210 and an inner wall 212. The inner wall 212 defines a central passage 214. An inlet 216 is defined by the inner wall 212 and an outlet 218 is defined between the outer wall 210 and the inner wall 212. The grill 206 is attached to the outer wall 210 and extends across the outlet 218.

As shown in FIG. 14, the shield 202 is coupled to the inner wall 212 and extends across the central passage 214. The shield 202 is located intermediate the ends of the inner wall 212. Accordingly, the shield 202 directs airflow in the central passage 214 towards an inlet 216. In addition, the shield 202 reduces recirculation of airflow that is discharged through the outlet 218. As a result, the shield 202 increases the operating efficiency of the hair dryer 200. In some embodiments, the shield 202 may be at least partially transparent or translucent. In further embodiments, the shield 202 may include a logo and/or a product identifier. Moreover, in some embodiments, the shield 202 may facilitate connecting attachments to the second end 108. In other embodiments, the hair dryer 200 may include other shields without departing from some aspects of the invention.

In the illustrated embodiment, the hair dryer 200 includes a light 220 positioned below the shield 202 and attached to the inner wall 212. For example, the light 220 may be mounted to a printed circuit board assembly (PCBA) attached to the inner wall 212. The light 220 is configured to direct light into the central passage 214 and at least partially illuminate the shield 202. In some embodiments, the light 220 is configured to change color based on an operational status of the hair dryer 200. Accordingly, the light 220 may increase the aesthetic appeal of the hair dryer 100 and allow the user to quickly determine information about the hair dryer 200. For example, in some embodiments, the light 220 may change from a first color, e.g., red, when the hair dryer 200 provides heated air to a second color, e.g., blue, when the hair dryer 200 provides airflow at or below the ambient temperature.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A handheld hair dryer comprising:

a body extending about an axis, the body including a first end, a second end, an inner wall, and an outer wall, wherein the outer wall is spaced radially outward from the inner wall, the inner wall and the outer wall defining a cavity therebetween, wherein a central passage is defined by the inner wall, and wherein the outer wall and the inner wall extend from the first end of the body to the second end of the body;

an inlet defined by the inner wall, wherein the inlet is in flow communication with the central passage to allow airflow in the central passage to be drawn into the cavity through the inlet, the inlet being defined by the inner wall intermediate the first end and the second end;

an outlet for the airflow to exit the cavity, wherein the hair dryer is configured to direct the airflow through the cavity and towards the outlet;

a handle connected to the body;

a fan; and a motor positioned at least partly within the handle and coupled to the fan.

2. A handheld hair dryer as set forth in claim 1, wherein the fan is positioned adjacent the inner wall and is configured to rotate about an axis perpendicular to the axis of the body.

3. A handheld hair dryer as set forth in claim 2, wherein the fan includes a hub and a plurality of blades extending from the hub, and wherein the blades are configured to direct air in a radial direction relative to the rotation axis of the fan.

4. A handheld hair dryer as set forth in claim 3, wherein the fan is positioned above the handle and is configured to direct airflow towards the cavity.

5. A handheld hair dryer as set forth in claim 1, wherein the central passage extends from the first end to the inlet, and the hair dryer is configured to draw airflow into the inlet from the central passage.

6. A handheld hair dryer as set forth in claim 1 further comprising a shield coupled to the inner wall at a location between the outlet and the inlet and configured to extend across the central passage and direct airflow toward the inlet.

7. A handheld hair dryer as set forth in claim 6, wherein the shield includes a transparent material.

8. A handheld hair dryer as set forth in claim 7 further comprising a light configured to illuminate the shield.

9. A handheld hair dryer as set forth in claim 8, wherein the light is configured to change color based on an operational status of the hair dryer.

10. A handheld hair dryer as set forth in claim 6, wherein the shield includes a logo.

11. An air-moving appliance comprising:

a cylindrical body extending about an axis, the body including a first end and a second end, the body defining a cavity and a central passage extending from the first end to the second end;

an inlet defined by the body, wherein the inlet is in flow communication with the central passage to allow airflow in the central passage to be drawn into the cavity through the inlet, the inlet being defined by the body intermediate the first end and the second end;

an outlet for the airflow to exit the cavity, wherein the air-moving appliance is configured to direct the airflow through the cavity and towards the outlet;

a handle connected to the body;

a fan positioned above the handle; and a motor positioned at least partly within the handle and coupled to the fan.

12. An air-moving appliance as set forth in claim 11, wherein the fan is configured to rotate about an axis perpendicular to the axis of the body.

13. An air-moving appliance as set forth in claim 12, wherein the fan includes a hub and a plurality of blades extending from the hub, and wherein the blades are configured to direct air in a radial direction relative to the rotation axis of the fan.

14. An air-moving appliance as set forth in claim 13, wherein the fan is configured to direct airflow towards the cavity.

15. An air-moving appliance as set forth in claim 13, wherein the air-moving appliance is configured to draw airflow into the inlet from the central passage.

16. An air-moving appliance as set forth in claim 11 further comprising a shield coupled to the body at a location between the outlet and the inlet and configured to extend across the central passage and direct airflow toward the inlet.

17. An air-moving appliance as set forth in claim 16, wherein the shield includes a transparent material.

18. An air-moving appliance as set forth in claim 17 further comprising a light configured to illuminate the shield.

19. An air-moving appliance as set forth in claim 18, wherein the light is configured to change color based on an operational status of the air-moving appliance.

20. An air-moving appliance as set forth in claim 16, wherein the shield includes a logo.

* * * * *